US006679360B2

(12) United States Patent
Wang

(10) Patent No.: US 6,679,360 B2
(45) Date of Patent: Jan. 20, 2004

(54) RETRACTABLE HANDLE FOR SUITCASE

(76) Inventor: King Sheng Wang, P.O. Box 63-99, Taichung (TW), 406

( * ) Notice: Subject to any disclaimer, the term of this patent is extended or adjusted under 35 U.S.C. 154(b) by 2 days.

(21) Appl. No.: 10/011,400

(22) Filed: Dec. 11, 2001

(65) Prior Publication Data

US 2003/0106755 A1 Jun. 12, 2003

(51) Int. Cl.[7] ..... A45C 13/26
(52) U.S. Cl. ..... 190/115; 16/113.1
(58) Field of Search ..... 16/113.1; 190/115; 280/655, 47.371, 37

(56) References Cited

U.S. PATENT DOCUMENTS 5,647,096 A * 7/1997 Chang ..... 16/113.1
5,653,319 A 8/1997 Wang
5,692,266 A * 12/1997 Tsai ..... 16/113.1
5,803,214 A 9/1998 Wang
5,864,921 A * 2/1999 Chou ..... 16/113.1
6,305,514 B1 * 10/2001 Lin et al. ..... 190/115
6,484,362 B1 * 11/2002 Kuo ..... 16/113.1

* cited by examiner

*Primary Examiner*—Tri M. Mai

(57) ABSTRACT

A retractable handle includes a barrel secured to a suitcase, a tube slidably received in the barrel and having a lock device secured to the lower end for selectively securing the tube to the barrel. A block is slidably received in the upper end of the tube and coupled to the lock device. A hand grip is secured to the tube and has a channel perpendicular to the tube, and a follower is slidably received in the channel of the hand grip and movable to engage with and to move the block along the tube. The hand grip may be disengaged from the corner areas of the suitcase.

7 Claims, 7 Drawing Sheets

RETRACTABLE HANDLE FOR SUITCASE

BACKGROUND OF THE INVENTION

1. Field of the Invention

The present invention relates to a handle, and more particularly to a retractable handle for suitcases.

2. Description of the Prior Art

Typical retractable handle for suitcases comprise a pair of telescopic tubes secured to the suitcase and extendible or retractable outward and inward of the suitcase, and a hand grip secured on top of the telescopic tubes for pulling the tubes inward and outward of the suitcase. The applicant has developed various kinds of retractable handles for suitcases, two of which have issued as U.S. Pat. No. 5,653,319 to Wang, and U.S. Pat. No. 5,803,214 to Wang. The hand grips of the typical retractable handles for suitcases are normally disposed in the upper and front corners of the suitcases and may be depressed inadvertently.

The present invention has arisen to mitigate and/or obviate the afore-described disadvantages of the conventional retractable handles for suitcases.

SUMMARY OF THE INVENTION

The primary objective of the present invention is to provide a retractable handle having a hand grip extended inward of the suitcase for preventing the hand grip from being depressed or actuated inadvertently.

In accordance with one aspect of the invention, there is provided a retractable handle for a suitcase, the retractable handle comprising a barrel for securing to the suitcase, a tube slidably received in the barrel, and including an upper end and a lower end, and including a longitudinal direction, a lock device attached to the lower end of the tube for selectively engaging with the barrel to secure the tube to the barrel, a block slidably received in the upper end of the tube, and coupled to the lock device for actuating the lock device, and movable in a moving direction parallel to or along the longitudinal direction of the tube, and including an inclined surface formed therein, a hand grip including a channel formed therein, and including an end portion having a conduit provided thereon, the conduit being perpendicular to the hand grip and secured onto the upper end of the tube and parallel to the tube, and the conduit including a chamber formed therein and perpendicular to and communicating with the channel of the hand grip, a follower slidably received in the channel of the hand grip, and movable in a direction perpendicular to the longitudinal direction of the tube and movable toward and away from the block, and including a first end having an inclined surface formed therein for engaging with the inclined surface of the block, and for moving the block away from the conduit and in a direction toward the lock device to actuate the lock device when the follower moves toward the block, and means for moving the follower toward the block to force the block to move along the tube and to actuate the lock device. The hand grip is arranged in a direction perpendicular to the tube and may be engaged inward of the suitcase and may be disengaged from the corner areas of the suitcase, for preventing the hand grip from being actuated inadvertently.

The moving means includes a bar slidably received in the hand grip and engaged with the follower for moving the follower to engage with the block.

The follower includes a second end having an inclined surface formed therein, the bar includes an inclined surface formed therein and engaged with the inclined surface of the second end of the follower for moving the follower toward and to engage with the block.

The hand grip includes an orifice formed therein, the bar includes a knob extendible outward through the orifice of the hand grip, for allowing the bar to be moved relative to the hand grip by depressing the knob.

A spring biasing device may further be provided for biasing the knob of the bar outward of the hand grip.

The barrel includes a rack secured therein, the lock device includes a gear engaged with the rack for controlling a movement of the lock device and the block relative to the tube.

The lock device includes a casing secured to the lower end of the tube for rotatably supporting the gear, and means for securing the gear to the casing.

The securing means includes a bracket having at least one tooth for engaging with and for securing the gear to the casing, and a rod securing the bracket to the block, for moving the bracket relative to the casing by the block.

A spring biasing device may further be provided for biasing the tooth of the bracket to engage with the gear.

The casing includes a chamber formed therein for receiving the gear, the bracket includes a first leg slidably received in the chamber of the casing and having the tooth provided thereon, the bracket includes a second leg extended outward of the casing and slidably received in the lower end of the tube and secured to the rod.

The casing includes at least one passageway formed therein, the bracket includes at least one link coupled between the first leg and the second leg of the bracket and slidably received in the passageway of the casing for allowing the second leg of the bracket to be slidably received in the lower end of the tube.

The bracket includes a gap formed between the fist leg and the second leg thereof, the casing includes a pair of tongues extended outward through the gap of the bracket, and a lid secured to the tongues and engaged with the bracket for securing the bracket to the casing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
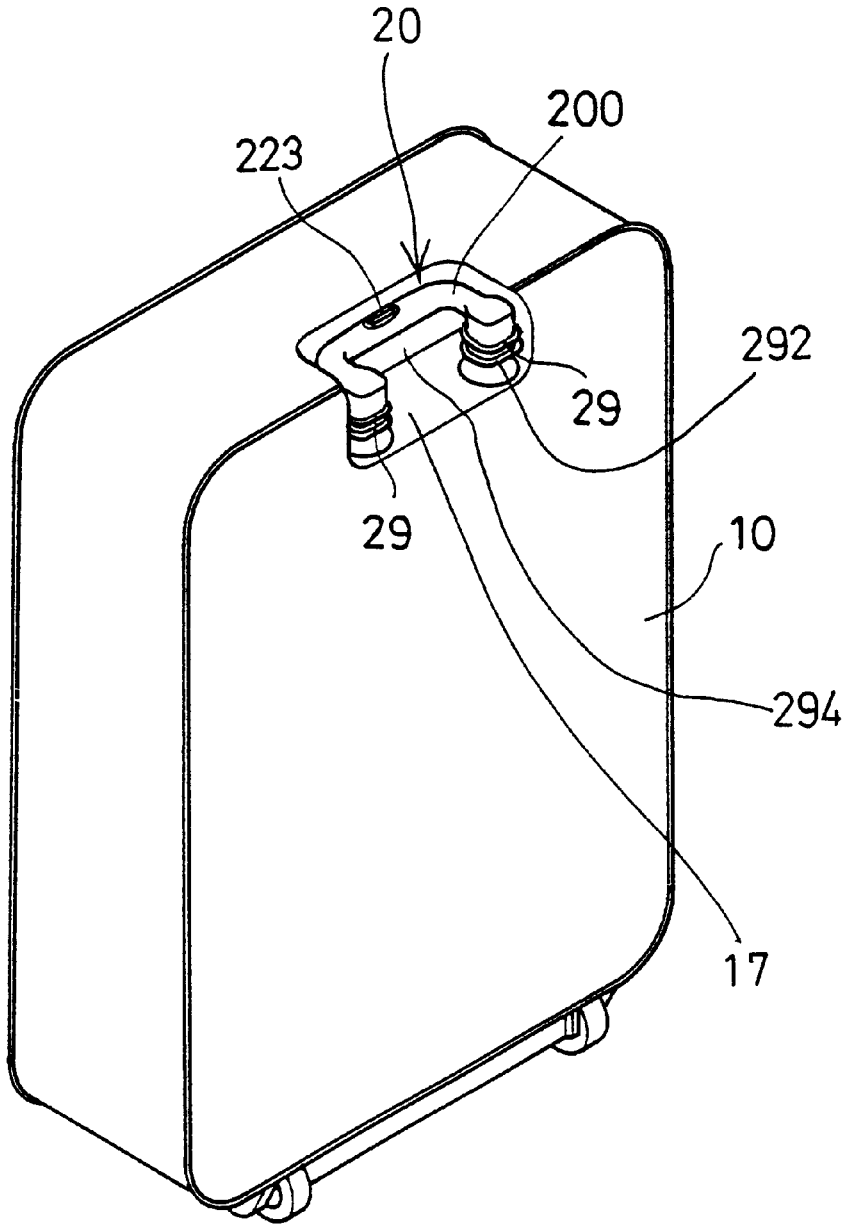
FIG. 1 is a perspective view of a suitcase having a retractable handle in accordance with the present invention.
Figure 2:
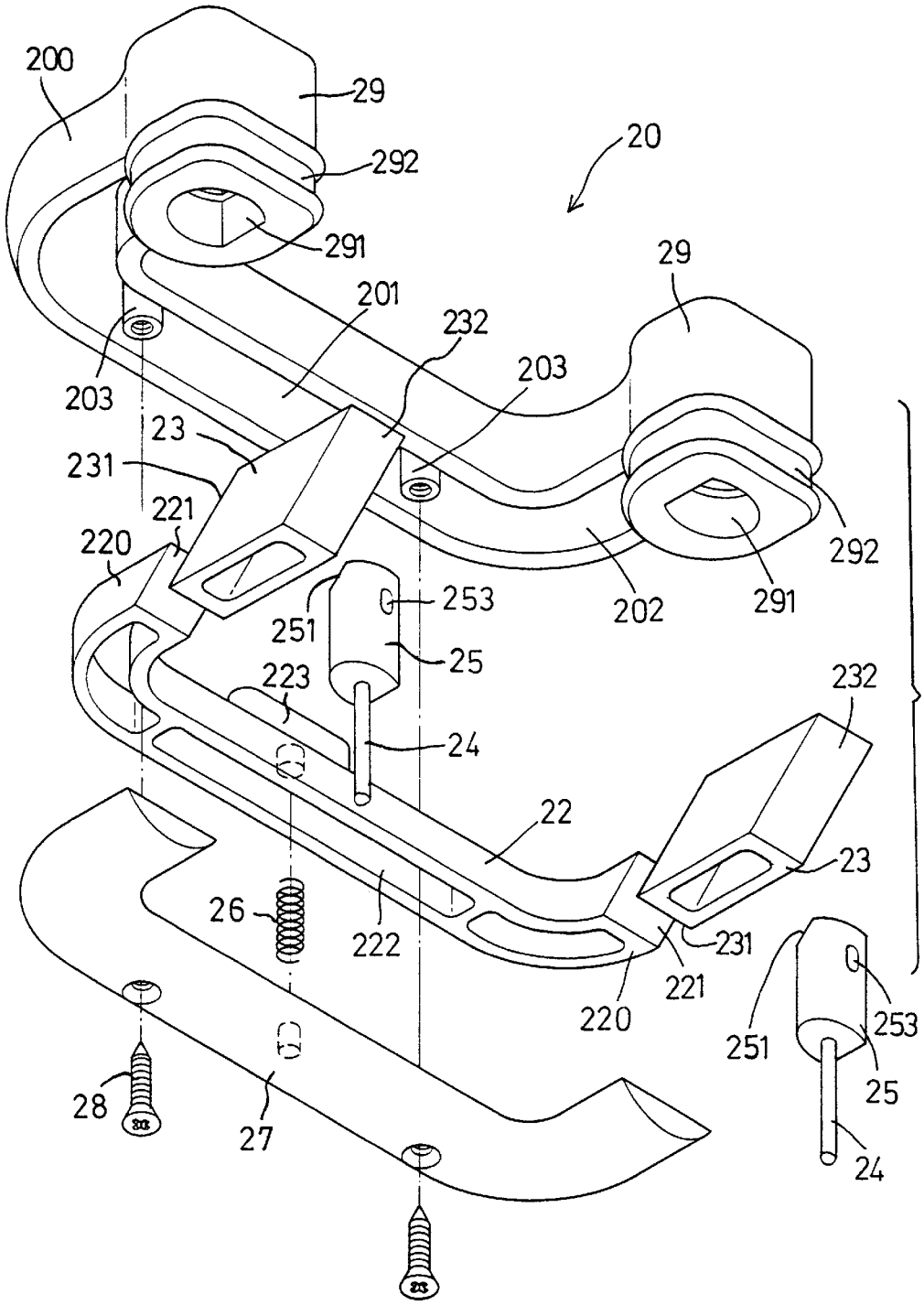
FIG. 2 is an exploded view of a hand grip of the retractable handle for the suitcase.

Referring to the drawings, and initially to FIGS. 1–5, a retractable handle 20 in accordance with the present invention is provided for attaching onto or into a suitcase 10. The suitcase 10 includes a cavity 17 formed in the upper portion thereof, particularly formed in the front and upper portion thereof for receiving a hand grip 200 of the retractable handle 20. The retractable handle 20 comprises one or more, particularly two ducts 11 secured on or in the suitcase 10. However, only one of the ducts 11 is shown and illustrated in FIG. 3, the other duct 11 is identical to that shown in FIG. 3. The ducts 11 each includes a bore 12 formed therein and each includes a spring biased latch 14 extended inward of the bore 12 of the duct 11.

The retractable handle 20 includes two barrels 50 engaged in the bores 12 of the ducts 11 respectively, and having a bore 51 formed therein, and each having a rack 52 secured to the barrel 50 and extended or provided in the bore 51 of the barrel 50, and each having a depression 53 provided therein for receiving the spring biased latch 14 of the duct 11 and for securing the barrel 50 in the duct 11. The barrel 50 includes a cut-off portion 55 for forming or defining a shoulder 56 in the upper portion thereof, and includes a peripheral flange 57 extended laterally outward from the top thereof for engaging with the duct 11 and for limiting the engagement of the barrel 50 into the duct 11.

The retractable handle 20 includes two tubes 30 slidably received in the bores 51 of the barrels 50 respectively, and each having an aperture 31 formed in the upper portion thereof for receiving a fastener or a shaft 293 (FIGS. 5, 6), and each having a bore 32 formed therein, and each having one or more spring biased catches 33 extended inward of the lower portion of the bore 32 thereof. The tubes 30 each includes one or more longitudinal flange 38 slidably engaged in the longitudinal groove 58 of the barrel 50, for stably guiding the tube 30 to slide longitudinally relative to the barrel 50 respectively. The tubes 30 are extendible or movable inward and outward of the barrels 50 and the ducts 11 respectively, such that the tubes 30 and the ducts 11 form a pair of retractable handle members.

The retractable handle 20 includes a U-shaped hand grip 200 arranged or disposed perpendicular to the tubes 30 and having a U-shaped space formed or defined by a passage 201 and two channels 202, and having one or more studs 203 extended inward of the passage 201 thereof. Two conduits 29 are secured to the ends of the hand grip 200, and each includes a chamber 291 formed therein and perpendicular to and communicating with the channels 202 of the hand grip 200 (FIGS. 5, 6) respectively, and each includes a pipe 292 extended downward beyond the hand grip 200 and engaged onto the tubes 30 respectively, and secured to the tubes 30 with the fasteners or shafts 293, such that a gap 294 (FIG. 1) may be formed between the hand grip 200 and the suitcase 10, and such that the hands of the users may be engaged into the gap 294 to grasp the hand grip 200.

Figure 6:
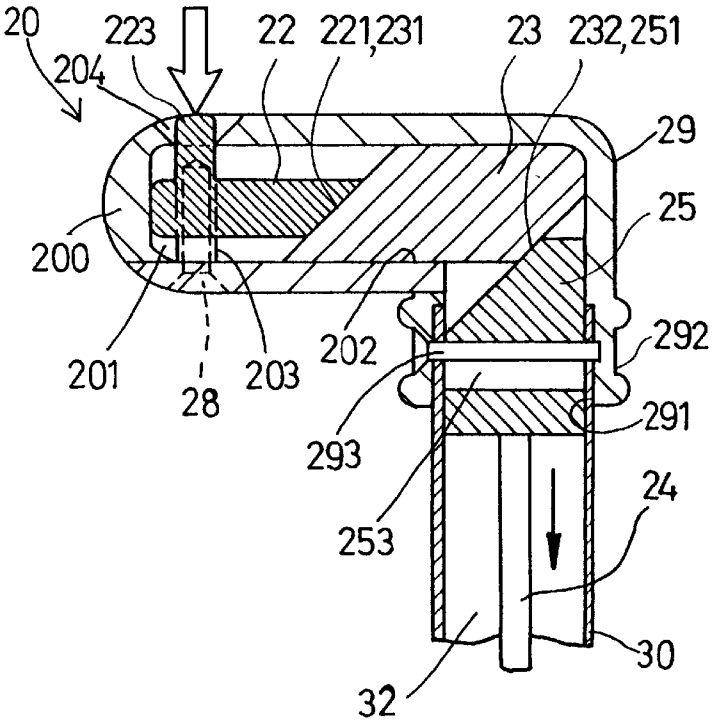
FIG. 6 is a cross sectional view similar to FIG. 5, illustrating the operation of the retractable handle for the suitcase.
Figure 5:
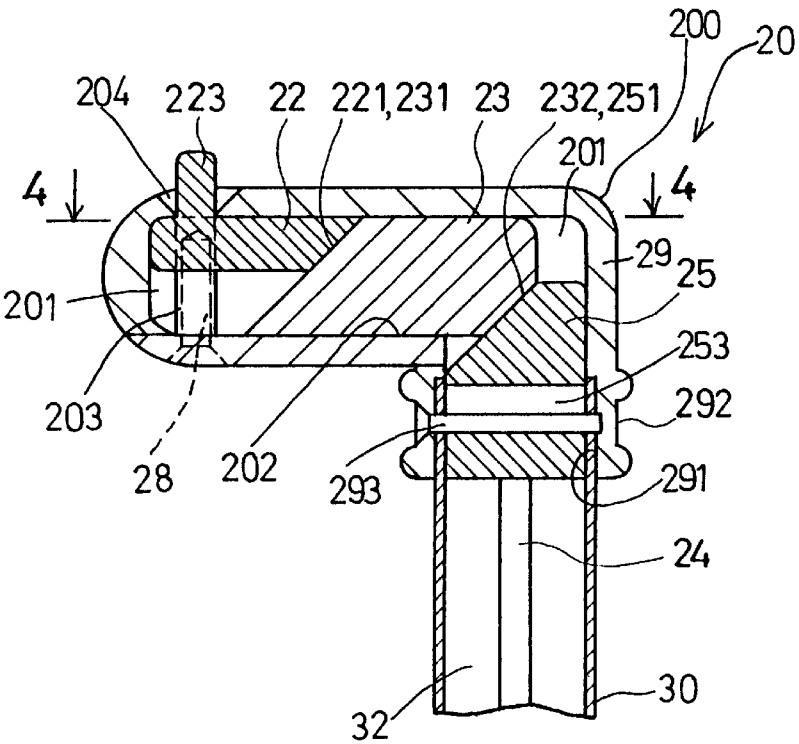
FIG. 5 is a partial cross sectional view taken along lines 5—5 of FIG. 4.

As best shown in FIGS. 5 and 6, the hand grip 200 is perpendicular to the conduits 29 and the tubes 30, and the channels 202 of the hand grip 200 are also perpendicular to the chambers 291 of the conduits 29 and perpendicular to the tubes 30 respectively. A U-shaped bar 22 is slidably received in the passage 201 and the channels 202 of the hand grip 20, and includes two ends 220 each having an inclined surface 221 formed therein, and includes a slot 222 formed therein for slidably receiving the studs 203 and for allowing the bar 220 to be slidably received in the passage 201 and the channels 202 of the hand grip 20. The bar 22 includes a knob 223 extended upward therefrom and extendible upward and outward through an orifice 204 of the hand grip 200 (FIGS. 5, 6), for allowing the bar 22 to be depressed and moved downward and inward of the hand grip 200. The U-shaped bar 22 may thus be guided to slide up and down along the passage 201 and the channels 202 of the hand grip 20, and slidable in a direction parallel to the longitudinal directions of the tubes 30.

Two followers 23 are slidably received in the channels 202 of the hand grip 200 and partially slidable inward of the chambers 291 of the conduits 29 respectively, and each includes an inclined surface 231 formed in one end thereof for slidably engaging with the inclined surface 221 of the bar 22 and for allowing the followers 23 to be moved toward or inward and outward of the chambers 291 of the conduits 29 respectively when the bar 22 is moved upward and downward relative to the hand grip 200. The bar 22 may thus be laterally moved in a direction perpendicular to the conduits 29 and the tubes 30. The followers 23 each includes an inclined surface 232 formed in the other end thereof and slidably received in the chambers 291 of the conduits 29 respectively.

One or both of the tubes 30 each includes a rod 24 slidably received therein and movable up and down relative to the tube 30, and each includes a block 25 secured on top of the rod 24 and moved in concert with the rod 24. The blocks 25 each includes an inclined surface 251 formed in the upper end thereof for slidably engaging with the inclined surface 232 of the follower 23 and for allowing the blocks 25 and thus the rods 24 to be moved upward and downward relative to the tubes 30 when the followers 23 are moved inward and outward of the chambers 291 of the conduits 29 respectively. The blocks 25 each includes an oblong hole 253 formed therein for slidably receiving the shafts 293 respectively and for limiting the upward and downward movement of the blocks 25 and the rods 24 relative to the tubes 30.

Accordingly, the blocks 25 and the rods 24 may thus be actuated and moved upward and downward along the tubes 30 by the upward and downward movement of the bar 22 relative to the hand grip 200, and by the lateral movement of the followers 23. The blocks 25 and the rods 24 may thus be moved in a direction perpendicular to the moving direction of the followers 23, and parallel to the moving direction of the bar 22. The moving direction of the bar 22 is also perpendicular to the moving direction of the followers 23. A cap 27 may be secured to the bottom portion of the hand grip 200 with fasteners 28, for enclosing the passage 201 and the channels 202 of the hand grip 200 and for stably retaining the bar 22 and the followers 23 within the hand grip 200. A spring 26 (FIG. 2) may be provided and engaged between the bar 22 and the hand grip 200 for biasing the hand grip 200 upward and for biasing the knob 223 of the bar 22 upward and outward through the orifice 204 of the hand grip 200.

Figure 3:
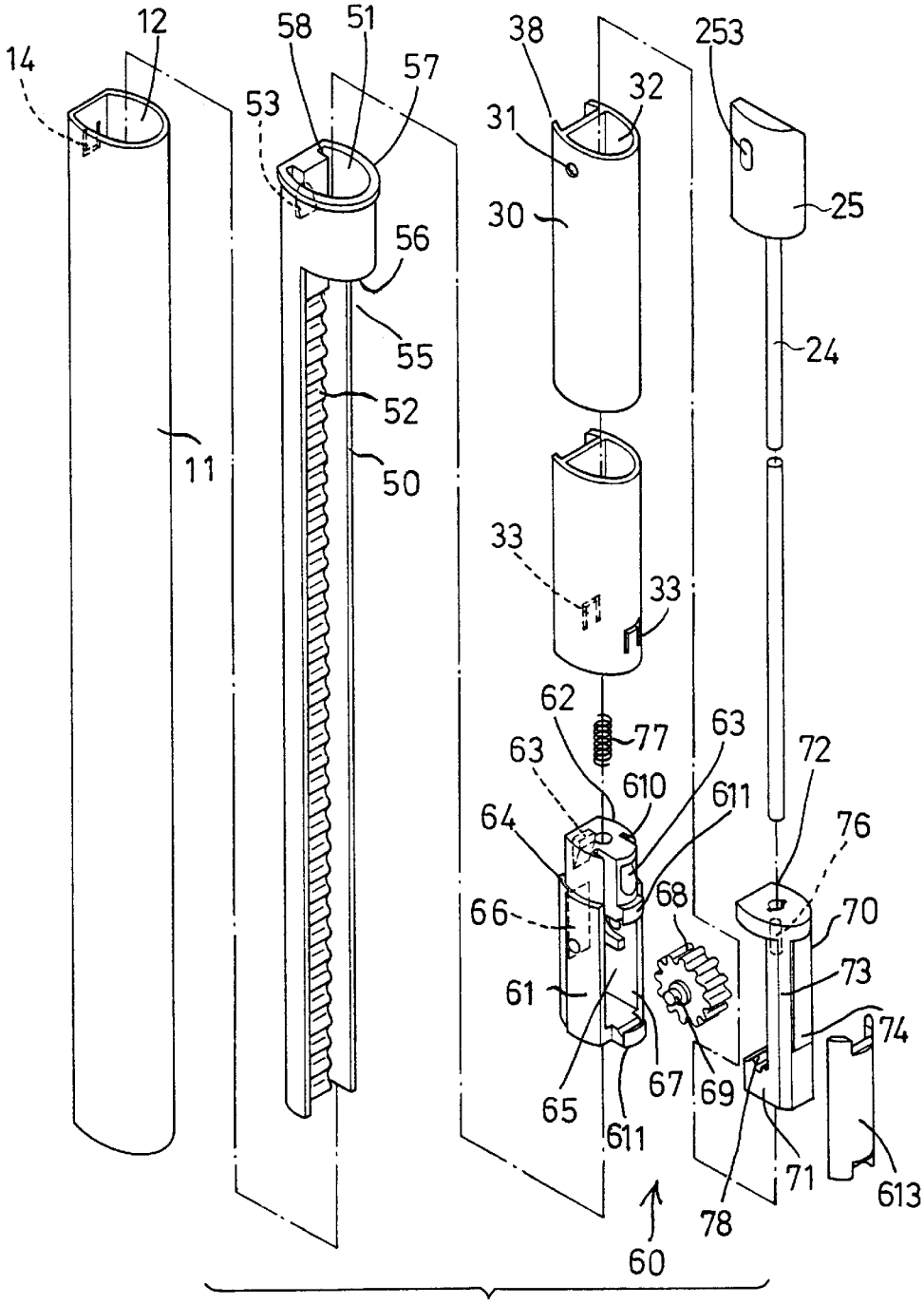
FIG. 3 is a partial exploded view of the retractable handle for the suitcase.
Figure 4:
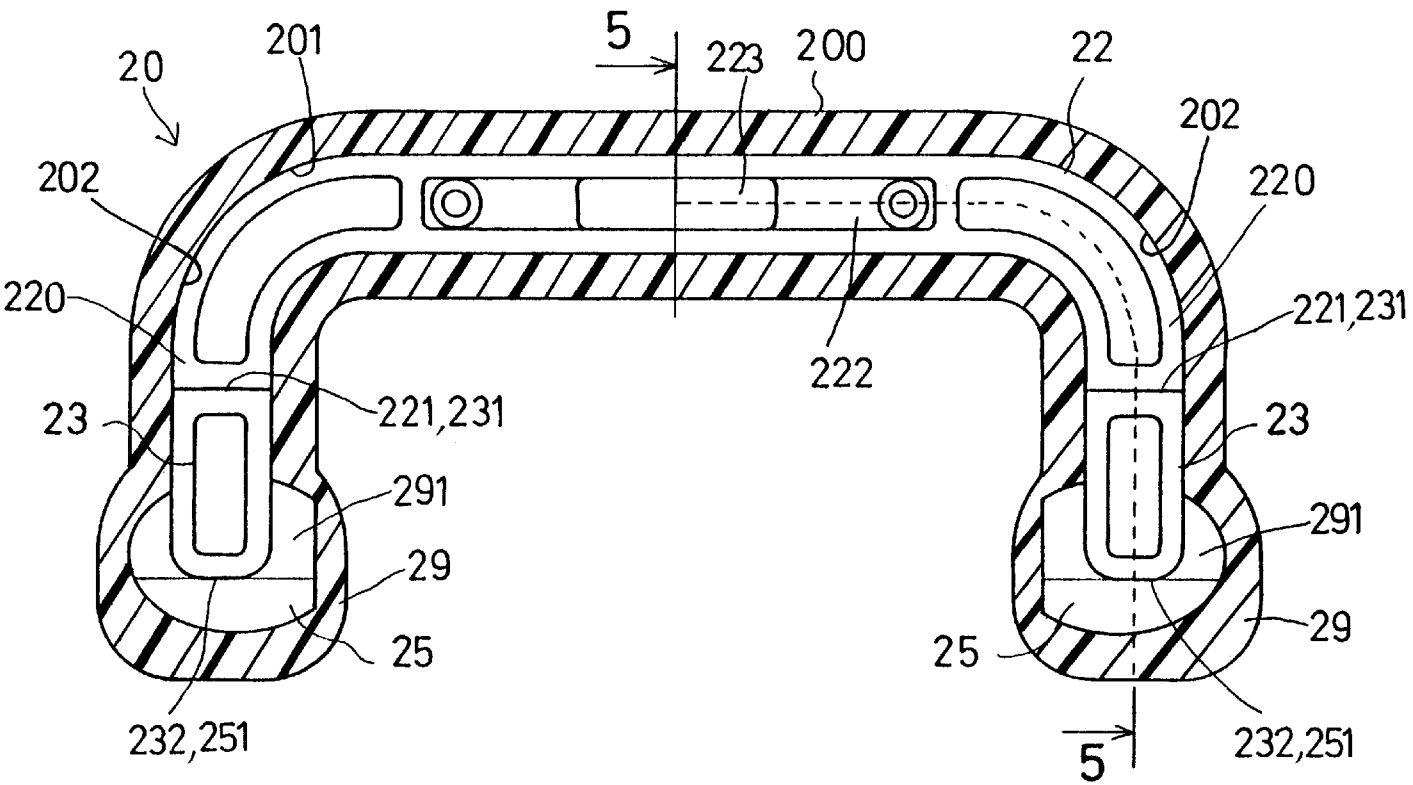
FIG. 4 is a cross sectional view taken along lines 4—4 of FIG. 5.
Figure 7:
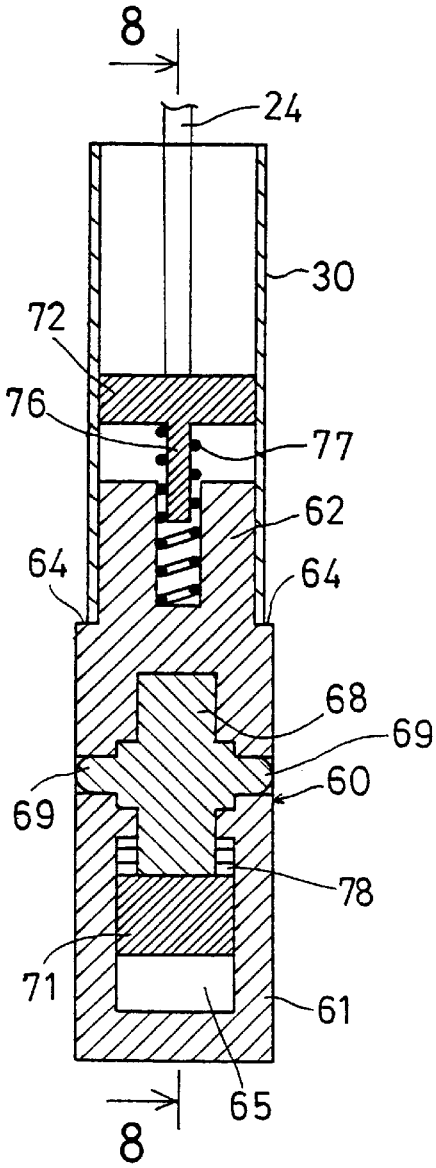
FIG. 7 is a partial cross sectional view taken along lines 7—7 of FIG. 8.
Figure 8:
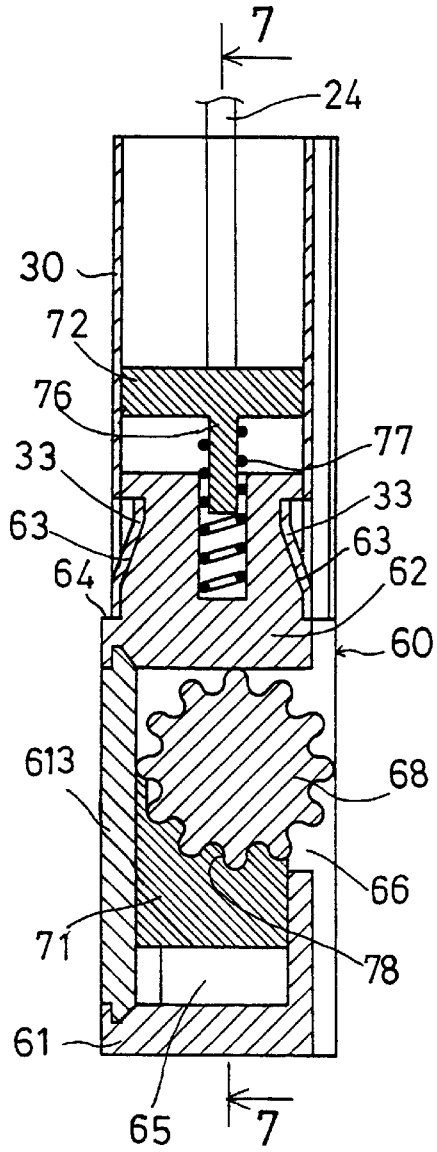
FIG. 8 is a partial cross sectional view taken along lines 8—8 of FIG. 7.

As shown in FIGS. 3, 7, 8, one or both of the tubes 30 each includes a lock device 60 attached to the lower end thereof. The lock device 60 includes a casing 61 having an extension 62 of smaller diameter provided or extended on top thereof, for forming a peripheral shoulder 64 between the casing 61 and the extension 62, and for engaging with the shoulder 56 of the barrel 50, and for preventing the casing 61 and thus the tube 30 from being disengaged from the barrel 50. The extension 62 is engaged into the lower end of the bore 32 of the respective tube 30, and includes one or more depressions 63 formed therein for receiving the spring biased catches 33 of the tube 30 and for securing the casings 61 to the lower ends of the tubes 30 respectively. The casing 61 includes a chamber 65 formed therein, and includes an aperture 66 and an opening 67 formed therein and opposite to each other, and communicating with the chamber 65 thereof.

A gear 68 is rotatably received and secured in the chamber 65 of the casing 61 with a pivot axle 69, and partially extended outward of the aperture 66 of the casing 61 for engaging with the rack 52 of the barrel 50. A bracket 70 includes a lower leg 71 slidably received in the chamber 65 of the casing 61, and an upper leg 72 provided above the casing 61 and slidably received in the tube 30, and one or more links 73 secured between the legs 71, 72 and slidably engaged in the passageways 610 of the casing 61 (FIG. 3), and a gap 74 formed in or between the links 73. The casing 61 includes a pair of tongues 611 extended therefrom and extended through the gap 74 of the bracket 70. A lid 613 is secured to the tongues 611 and engaged with the bracket 70 for slidably securing the bracket 70 to the casing 61 and for allowing the bracket 70 to be slided up and down relative to the casing 61.

The brackets 70 are secured to the lower ends of the rods 24 respectively, and moved in concert with the rods 24 respectively, such that the brackets 70 may be caused to move up and down relative to the casing 61. The brackets 70 each includes one or more teeth 78 formed or provided on the lower leg 71 thereof for engaging with the gear 68, and each includes a pin 76 extended downward from the upper leg 72 and extended toward the casing 61. A spring 77 is engaged on the pin 76 and engaged between the casing 61 and the bracket 70 for biasing the teeth 78 of the bracket 70 to engage with the gear 68 and to lock the gear 68 and the casing 61 and the bracket 70 to the barrel 50, and thus for locking the tube 30 to the barrel 50 and the duct 11.

As shown in FIG. 8, when the teeth 78 of the bracket 70 are caused or biased to engage with the gear 68, the gear 60 may be retained and locked in place by the bracket 70 and thus may not be rotated relative to the casing 61 and may not be rotated or moved relative to the rack 52 of the barrel 50. The gear 68 and thus the casing 61 and the bracket 70 may thus be locked to the barrel 50. The teeth 78 of the bracket 70 may be disengaged from the gear 68 to unlock or to release the gear 68 and the casing 61 from the barrel 50 when the bracket 70 is moved toward the casing 61 against the spring 77 by the rod 24 and the block 25. The gear 60 may be rotated or moved along the rack 52 of the barrel 50 when the teeth 78 of the bracket 70 may be disengaged from the gear 68.

In operation, as shown in FIG. 6, when the knob 223 of the bar 22 is depressed downward and inward of the hand grip 200, the follower 23 may be forced to move away from the bar 22 and may be moved in a direction perpendicular to the moving direction of the bar 22. The block 25 and thus the rod 24 may then be forced to move downward along the tube 30 by the sliding engagement between the inclined surfaces 232, 251 of the follower 23 and the block 25, in order to force and to move the bracket 70 relative to the casing 61, and to disengage the teeth 78 from the gear 68, and thus to release the gear 68. The gear 68 may thus be moved relative to the rack 52 of the barrel 50 when the tube 30 is pulled and moved relative to the barrel 50 and the duct 11, and such that the tube 30 may be moved inward and outward of the duct 11. The teeth 78 of the bracket 70 may be forced to engage with the gear 68 and to lock the gear 68 to the casing 61 by the spring 77 when the knob 223 is released. The spring 26 (FIG. 2) may be used for biasing the bar 22 upward relative to the hand grip 200.

Figure 9:
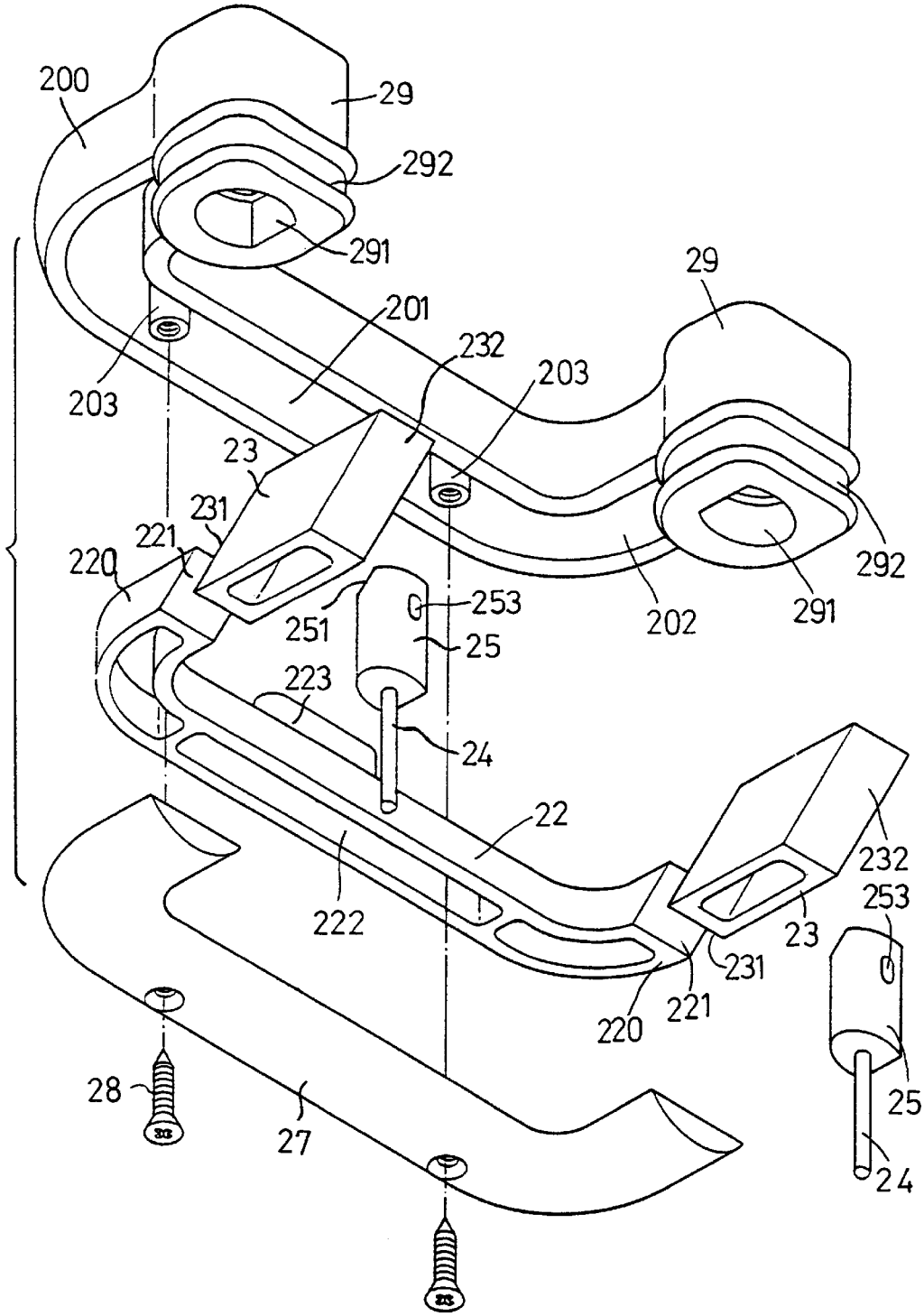
FIG. 9 is an exploded view similar to FIG. 2, illustrating the other embodiment of the hand grip for the retractable handle of the suitcase.

Referring next to FIG. 9, without the spring 26, the bar 22 may also be moved upward relative to the hand grip 200 by the follower 23 and the block 25 when the block 25 and the rod 24 are moved or biased upward relative to the tube 30 by the spring 77 that is shown in FIGS. 3, 7, and 8.

Accordingly, the retractable handle in accordance with the present invention includes a hand grip extended inward of the suitcase for preventing the hand grip from being depressed or actuated inadvertently.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A retractable handle for a suitcase, said retractable handle comprising:

a barrel for securing to the suitcase, said barrel including a rack secured therein.

a tube slidably received in said barrel, and including an upper end and a lower end, and including a longitudinal direction, a lock device attached to said lower end of said tube for selectively engaging with said barrel to secure said tube to said barrel, said lock device including a gear engaged with said rack for controlling a movement of said lock device and said block relative to said tube, said lock device including a casing secured to said lower end of said tube for rotatably supporting said gear, said casing including a chamber formed therein for receiving said gear, said casing including a pair of tongues extended therefrom, a block slidably received in said upper end of said tube, and coupled to said lock device for actuating said lock device, and movable in a moving direction parallel to or along said longitudinal direction of said tube, and including an inclined surface formed therein, means for securing said gear to said casing, said securing means including a bracket having at least one tooth for engaging with and for securing said gear to said casing, and a rod securing said bracket to said block, for moving said bracket relative to said casing by said block, said bracket including a first leg slidably received in said chamber of said casing and having said at least one tooth provided thereon, said bracket including a second leg extended outward of said casing and slidably received in said lower end of said tube and secured to said rod, said bracket including a gap formed between said first leg and said second leg thereof, said pair of tongues of said casing being extended outward through said gap of said bracket, and a lid secured to said tongues of said casing and engaged with said bracket for securing said bracket to said casing, a hand grip including a channel formed therein, and including an end portion having a conduit provided thereon, said conduit being perpendicular to said hand grip and secured onto said upper end of said tube and parallel to said tube, and said conduit including a chamber formed therein and perpendicular to and communicating with said channel of said hand grip, a follower slidably received in said channel of said hand grip, and movable in a direction perpendicular to said longitudinal direction of said tube and movable toward and away from said block, and including a first end having an inclined surface formed therein for engaging with said inclined surface of said block, and for moving said block away from said conduit and in a direction toward said lock device to actuate said lock device when said follower moves toward said block, and means for moving said follower toward said block to force said block to move along said tube and to actuate said lock device.

2. The retractable handle according to claim 1, wherein said moving means includes a bar slidably received in said hand grip and engaged with said follower for moving said follower to engage with said block.

3. The retractable handle according to claim 2, wherein said follower includes a second end having an inclined surface formed therein, said bar includes an inclined surface formed therein and engaged with said inclined surface of said second end of said follower for moving said follower toward and to engage with said block.

4. The retractable handle according to claim 2, wherein said hand grip includes an orifice formed therein, said bar includes a knob extendible outward through said orifice of said hand grip, for allowing said bar to be moved relative to said hand grip by depressing said knob.

5. The retractable handle according to claim 4 further comprising means for biasing said knob of said bar outward of said hand grip.

6. The retractable handle according to claim 1 further comprising means for biasing said at least one tooth of said bracket to engage with said gear.

7. The retractable handle according to claim 1, wherein said casing includes at least one passageway formed therein, said bracket includes at least one link coupled between said first leg and said second leg of said bracket, said second leg of said bracket is slidably received in said lower end of said tube.

* * * * *